US006599158B2

(12) United States Patent
Shidara et al.

(10) Patent No.: US 6,599,158 B2
(45) Date of Patent: Jul. 29, 2003

(54) IDLING SPEED CONTROL SYSTEM FOR OUTBOARD MOTOR

(75) Inventors: Sadafumi Shidara, Wako (JP); Ryuichi Kimata, Wako (JP); Nobuhiro Takahashi, Takanezawa-machi (JP)

(73) Assignees: Honda Giken Kogyo Kabushiki Kaisha, Tokyo (JP); Keihin Corporation, Tokyo (JP)

( * ) Notice: Subject to any disclaimer, the term of this patent is extended or adjusted under 35 U.S.C. 154(b) by 0 days.

(21) Appl. No.: 09/805,941

(22) Filed: Mar. 15, 2001

(65) Prior Publication Data

US 2001/0023155 A1 Sep. 20, 2001

(30) Foreign Application Priority Data

Mar. 17, 2000 (JP) ..... 2000-077062

(51) Int. Cl.[7] ..... B63H 23/00

(52) U.S. Cl. ..... 440/1; 440/87; 123/336; 123/339.19; 123/339.23

(58) Field of Search ..... 440/1, 87, 88; 123/336, 339.16, 339.19, 339.23

(56) References Cited

U.S. PATENT DOCUMENTS 4,359,983 A * 11/1982 Carlson et al. ..... 123/339.26
4,787,351 A * 11/1988 Sakamoto et al. ..... 123/339.22
5,110,312 A * 5/1992 Higby ..... 440/75
5,146,888 A * 9/1992 Sawamoto ..... 123/336
5,203,300 A * 4/1993 Orzel ..... 123/339.21
5,364,322 A * 11/1994 Fukui ..... 477/108
5,685,270 A * 11/1997 Sekiguchi et al. ..... 123/339.21
5,765,528 A * 6/1998 Kamimaru ..... 123/339.14
5,894,828 A * 4/1999 Sivashankar et al. .. 123/339.11
5,910,191 A * 6/1999 Okamoto ..... 440/86
5,921,828 A * 7/1999 Ogino ..... 440/86
5,975,048 A * 11/1999 Sivashankar et al. .. 123/339.12
6,035,652 A * 3/2000 Hashimoto ..... 123/339.17
6,077,136 A * 6/2000 Arai et al. ..... 440/86
6,098,591 A * 8/2000 Iwata ..... 123/339.11
6,109,986 A * 8/2000 Gaynor et al. ..... 440/1
6,123,591 A * 9/2000 Onoue ..... 440/75
6,415,766 B1 * 7/2002 Kanno et al. ..... 123/339.19

* cited by examiner

*Primary Examiner*—S. Joseph Morano
*Assistant Examiner*—Lars A. Olson
(74) *Attorney, Agent, or Firm*—Armstrong, Westerman & Hattori, LLP

(57) ABSTRACT

An idling speed control system for an outboard motor mounted on a boat and equipped with an internal combustion engine, whose output is connected to a propeller through a clutch, having secondary air supplier that supplies secondary air. In the system, the engine start-state as to whether the engine has been started is determined and the clutch position is detected and based thereon, the desired idling speed and the desired secondary air supply amount is determined through learning control. With this, the system can therefore accurately determine the desired idling speed and the desired secondary air supply amount and achieve steady idling speed even if load changes owing to a change in clutch position or propeller replacement.

15 Claims, 15 Drawing Sheets

IDLING SPEED CONTROL SYSTEM FOR OUTBOARD MOTOR

BACKGROUND OF THE INVENTION

1. Field of the Invention

This invention relates to an idling speed control system for an outboard motor, particularly to an idling speed control system for an outboard motor for small boats 2. Description of the Related Art Small motor-driven boats are generally equipped with a propulsion unit including an internal combustion engine, propeller shaft and propeller integrated into what is called an outboard motor or engine. The outboard motor is mounted on the outside of the boat and the output of the engine is transmitted to the propeller through a clutch and the propeller shaft. The boat can be propelled forward or backward by moving the clutch from Neutral to Forward or Reverse position.

The idling speed of this type of the engine is controlled by use of a secondary air supplier that supplies secondary air through a passage that is connected to the air intake pipe downstream of the throttle valve. The passage is equipped with a secondary air control valve and the desired idling speed is obtained by regulating the opening of the secondary air control valve.

The amount of secondary air required to achieve the desired idling speed varies with aged deterioration of the engine. It also differs with clutch position. This is because the idling speed differs between that when the clutch is in Neutral and that when it is in Forward or Reverse and the outboard engine is running forward or backward at very low speed, i.e., during trolling.

To give a specific example, say that the idling speed is 750 rpm when the clutch is in Neutral. When the clutch is then shifted into Forward or Reverse for low-speed trolling, the added load of the hull causes the engine speed to fall to the trolling speed (herein defined as the idling speed during trolling) of around 650 rpm. The required amount of secondary air changes as a result.

If the owner of the outboard motor should replace the propeller, which is not uncommon, the resulting load change will change the engine speed and, accordingly, change the amount of secondary air required to achieve the desired idling speed. Conventional idling speed control does not take clutch position and propeller replacement into account and stands in need of improvement in this respect.

SUMMARY OF THE INVENTION

An object of the present invention is therefore to achieve this improvement by providing an idling speed control system for an outboard motor that is equipped with an internal combustion engine responsive to shifting of a clutch from Neutral to Forward or Reverse for driving a boat forward or backward according to the clutch position after shifting and that supplies secondary air in such amount as to reduce deviation between a determined desired idling speed and a detected engine speed, which idling speed control system for an outboard motor accurately determines a desired idling speed and a desired amount of supplied secondary air so as to achieve steady idling even when load varies owing to operation (shifting) of the clutch or propeller replacement.

For realizing this object, a first aspect of this invention provides a system for controlling an idling speed for an outboard motor mounted on a boat and equipped with the engine whose output is connected to a propeller through a clutch such that the boat is propelled forward or reverse when the clutch is changed to a neutral position to a forward position or a reverse position, having: secondary air supplier that supplies secondary air trough a passage that is connected to an air intake pipe downstream of a throttle valve and that is equipped with a secondary air control valve such that amount of secondary air is supplied to the air intake pipe in response to an opening of the secondary air control valve; engine operating condition detecting means for detecting parameters indicative of operating conditions of the engine including at least an engine speed; engine start-state determining means for determining engine start-state as to whether the engine has been started based on one of the detected parameters; desired value determining means for determining a desired idling speed and for determining a desired secondary air supply amount such that a deviation between the determined desired idling speed and the detected engine speed decreases; and valve controlling means for controlling the opening of the valve to a value that effects the desired secondary air supply amount; wherein the improvement comprising: the system includes: clutch position detecting means for detecting the position of the clutch; and wherein the desired value determining means determines the desired idling speed and the desired secondary air supply amount based on the determined engine start-state and the detected clutch position. With this, the system can therefore accurately determine the desired idling speed and the desired secondary air supply amount and achieve steady idling speed even if load changes owing to a change in clutch position or propeller replacement.

In accordance with a second aspect of the invention, the desired value determining means learning-controls the determined desired secondary air supply amount. With this, the system can also accurately determine the desired idling speed and the desired amount of supplied secondary air and achieve steady idling speed even if load changes owing to a change in clutch position or propeller replacement.

In accordance with a third aspect, the desired value determining means learning-controls the determined desired secondary air supply amount such that the deviation between the desired idling speed and the detected engine speed decreases. With this, the system can therefore achieve steady idling speed even if load changes owing to a change in clutch position or propeller replacement and, in addition, by enabling steady low engine speed during slow advance with the clutch shifted to Forward (or Reverse) position can enhance fuel performance.

In accordance with a fourth aspect, the desired value determining means determines to correct the desired secondary air supply amount by a prescribed amount such that the deviation between the desired idling speed and the detected engine speed decreases, when the clutch position is shifted or changed. With this, the system can similarly achieve the same results mentioned above.

DETAILED DESCRIPTION OF THE PREFERRED EMBODIMENT

An idling speed control system for an outboard motor according to an embodiment of the present invention will now be explained with reference to the attached drawings.

Figure 1:
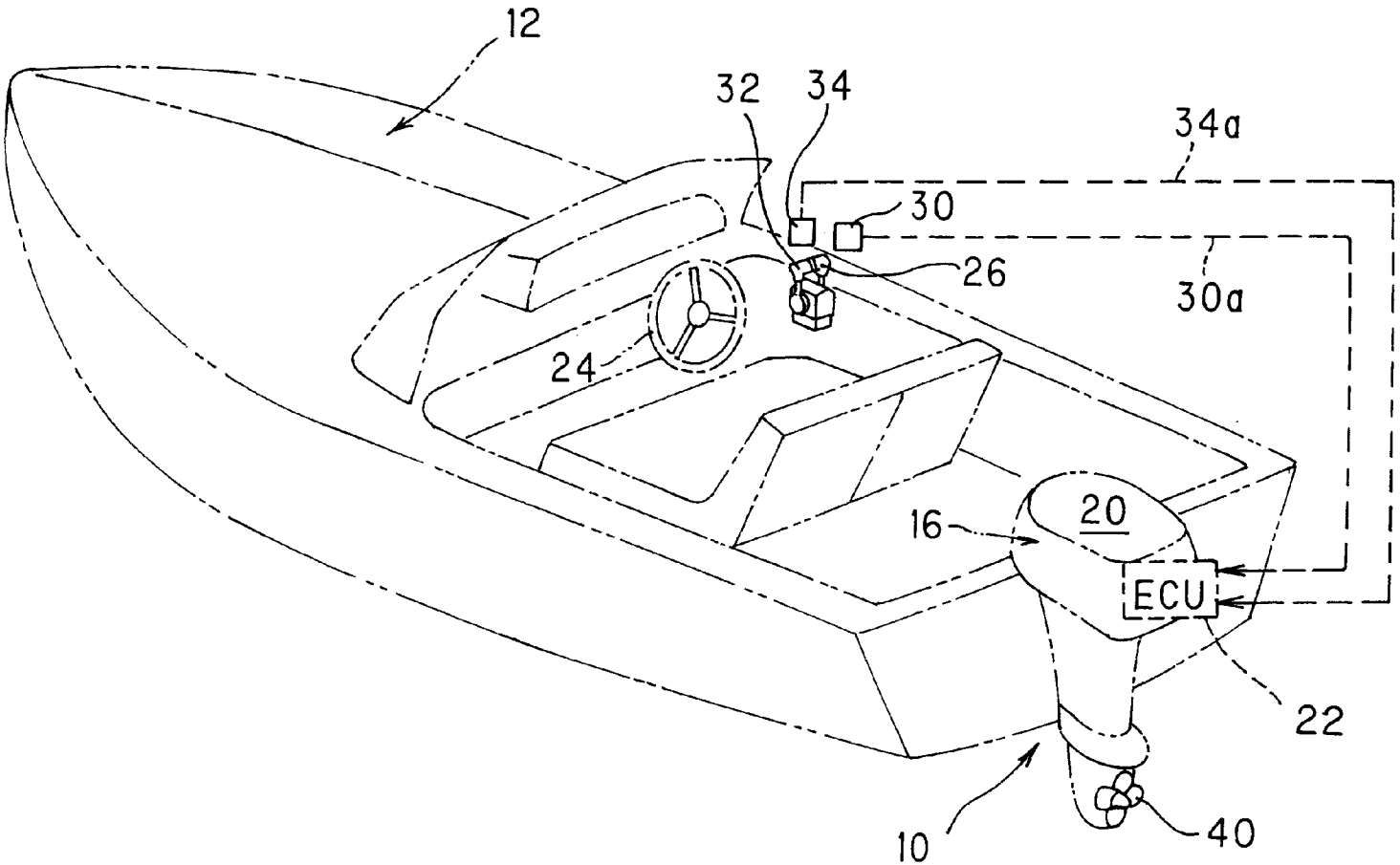
FIG. 1 is a schematic view showing the overall configuration of an idling speed control system for an outboard motor equipped with an internal combustion engine according to an embodiment of the present invention.
Figure 2:
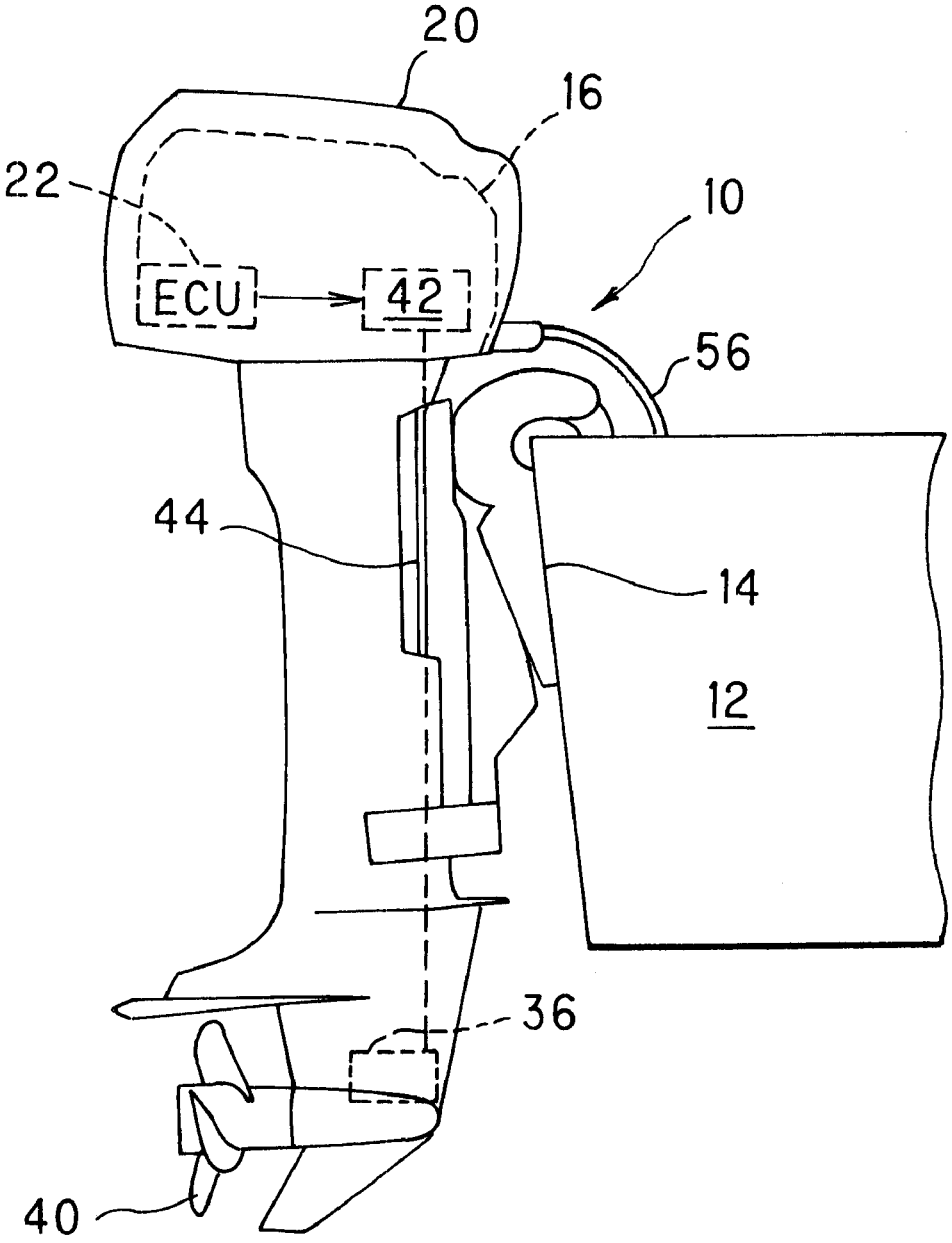
FIG. 2 is an enlarged side view of one portion of FIG. 1.

FIG. 1 is a schematic view showing the overall configuration of the idling speed control system for an outboard motor and FIG. 2 is an enlarged side view of one portion of FIG. 1.

Reference numeral 10 in FIGS. 1 and 2 designates the aforesaid propulsion unit including an internal combustion engine, propeller shaft and propeller integrated into what is hereinafter called an "outboard motor." The outboard motor 10 is mounted on the stem of a boat (small craft) 12 by a clamp unit 14 (see FIG. 2).

As shown in FIG. 2, the outboard motor 10 is equipped with the internal combustion engine (hereinafter called the "engine") 16. The engine 16 is a spark-ignition V-6 gasoline engine. The engine is positioned above the water surface and is enclosed by an engine cover 20 of the outboard motor 10. An electronic control unit (ECU) 22 composed of a microcomputer is installed near the engine 16 enclosed by the engine cover 20.

As shown in FIG. 1, a steering wheel 24 is installed in the cockpit of the boat 12. When the operator turns the steering wheel 24, the rotation is transmitted to a rudder (not shown) fastened to the stem through a steering system not visible in the drawings, changing the direction of boat advance.

A throttle lever 26 is mounted on the right side of the cockpit and near it is mounted a throttle lever position sensor 30 that outputs a signal corresponding to the position of the throttle lever 26 set by the operator.

A shift lever 32 is provided adjacent to the throttle lever 26 and next to it is installed a neutral switch 34 that outputs an ON signal when the operator puts the shift lever 32 in Neutral and outputs an OFF signal when the operator puts the shift lever 32 in Forward or Reverse. The outputs from the throttle lever position sensor 30 and neutral switch 34 are sent to the ECU 22 through signal lines 30*a* and 34*a*.

The output of the engine 16 is transmitted through a crankshaft and a drive shaft (neither shown) to a clutch 36 of the outboard engine 10 located below the water surface. The clutch 36 is connected to a propeller through a propeller shaft (not shown).

The clutch 36, which comprises a conventional gear mechanism, is omitted from the drawing. It is composed of a drive gear that rotates unitarily with the drive shaft when the engine 16 is running, a forward gear, a reverse gear, and a dog (sliding clutch) located between the forward and reverse gears that rotates unitarily with the propeller shaft. The forward and reverse gears are engaged with the drive gear and rotate idly in opposite directions on the propeller shaft.

The ECU 22 is responsive to the output of the neutral switch 34 received on the signal line 34*a* for driving an actuator (electric motor) 42 via a drive circuit (not shown) so as to realize the intended shift position. The actuator 42 drives the dog through a shift rod 44.

When the shift lever 32 is put in Neutral, the engine 16 and the propeller shaft are disconnected and can rotate independently. When the shift lever 32 is put in Forward or Reverse position, the dog is engaged with the forward gear or the reverse gear and the rotation of the engine 16 is transmitted through the propeller shaft to the propeller to drive the propeller in the forward direction or the opposite (reverse) direction and thus propel the boat 12 forward or backward.

The engine 16 will now be explained with reference to FIGS. 3 and 4.

Figure 3:
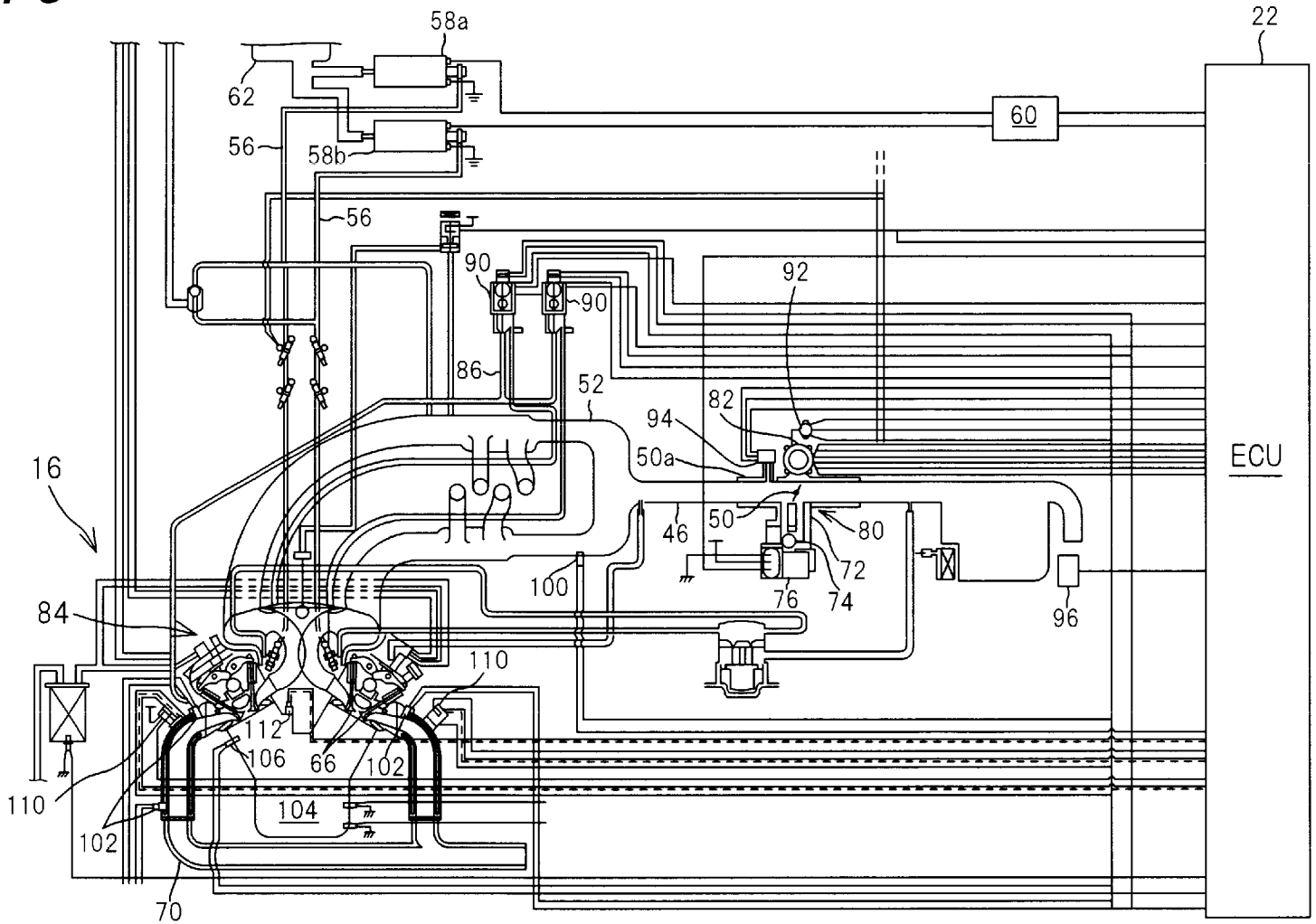
FIG. 3 is a schematic diagram showing details of the engine of the motor shown in FIG. 1.

As shown in FIG. 3, the engine 16 is equipped with an air intake pipe 46. Air drawn in through an air cleaner (not shown) is supplied to intake manifolds 52 provided one for each of left and right cylinder banks disposed in V-like shape as viewed from the front, while the flow thereof is adjusted by a throttle valve 50, and finally reaches intake valves (not shown) of the respective cylinders. An injector 54 (not shown in FIG. 3) is installed in the vicinity of each intake valve (not shown) for injecting fuel (gasoline).

The injectors 54 are connected through two fuel lines 56 provided one for each cylinder bank to a fuel tank (not shown) containing gasoline. The fuel lines 56 pass through separate fuel pumps 58*a* and 58*b* equipped with electric motors (not shown) that are driven via a relay circuit 60 so as to send pressurized gasoline to the injectors. Reference numeral 62 designates a vaporized fuel separator.

The intake air is mixed with the injected gasoline to form an air-fuel mixture that passes into the combustion chamber (not shown) of each cylinder, where it is ignited by a spark plug 64 (not shown in FIG. 3) to bum explosively and drive down a piston (not shown). The so-produced engine output is taken out through a crankshaft. The exhaust gas produced by the combustion passes out through exhaust valves 66 into exhaust manifolds 70 provided one for each cylinder bank and is discharged to the exterior of the engine.

As illustrated, a branch passage 72 for secondary air supply is formed to branch off from the air intake pipe 46 upstream of the throttle valve 50 and rejoin the air intake pipe 46 downstream of the throttle valve 50. The branch passage 72 is equipped with an electronic secondary air control valve (EACV) 74. The EACV 74 is connected to an actuator (electromagnetic solenoid).

The actuator 76 is connected to the ECU 22. As explained further later, the ECU 22 calculates a current command value that it supplies to the actuator 76 so as to drive the EACV 74 for regulating the opening of the branch passage 72. The branch passage 72, the EACV 74 and the actuator 76 thus constitute a secondary air supplier 80 for supplying secondary air in proportion to the opening of the EACV 74.

The throttle valve 50 is connected to an actuator (stepper motor) 82. The actuator 82 is connected to the ECU 22. The ECU 22 calculates a current command value proportional to the output of the throttle lever position sensor 30 and supplies it to the actuator 82 through a drive circuit (not shown) so as to regulate the throttle opening TH.

More specifically, the actuator 82 is directly attached to a throttle body 50*a* housed in the throttle valve 50 with its rotating shaft (not shown) oriented to be coaxial with the throttle valve shaft. In other words, the actuator 82 is attached to the throttle body 50*a* directly, not through a linkage, so as to simplify the structure and save mounting space.

Thus, in this embodiment, the push cable is eliminated and the actuator 82 is directly attached to the throttle body 50*a* for driving the throttle valve 50.

The engine 16 is provided in the vicinity of the intake valves and the exhaust valves 66 with a variable valve timing system 84. When engine speed and load are relatively high, the variable valve timing system 84 switches the valve open time and lift to relatively large values (Hi V/T). When the engine speed and load are relatively low, it switches the valve open time and lift to relatively small values (Lo V/T).

The exhaust system and the intake system of the engine 16 are connected by EGR (exhaust gas recirculation) passages 86 provided therein with EGR control valves 90. Under prescribed operating conditions, a portion of the exhaust gas is returned to the air intake system.

The actuator 82 is connected to a throttle opening sensor 92 responsive to rotation of the throttle shaft for outputting a signal proportional to the throttle opening TH. A manifold absolute pressure sensor 94 is installed downstream of the throttle valve 50 for outputting a signal proportional to the manifold absolute pressure PBA in the air intake pipe (engine load). In addition, an atmospheric air pressure sensor 96 is installed near the engine 16 for outputting a signal proportional to the atmospheric air pressure PA.

An intake air temperature sensor 100 installed downstream of the throttle valve 50 outputs a signal proportional to the intake air temperature TA. Three overheat sensors 102 installed in the exhaust manifolds 70 of the left and right cylinder banks output signals proportional to the engine temperature. A coolant temperature sensor 106 installed at an appropriate location near the cylinder block 104 outputs a signal proportional to the engine coolant temperature TW.

$O_2$ sensors 110 installed in the exhaust manifolds 70 output signals reflecting the oxygen concentration of the exhaust gas. A knock sensor 112 installed at a suitable location on the cylinder block 104 outputs a signal related to knock.

Figure 4:
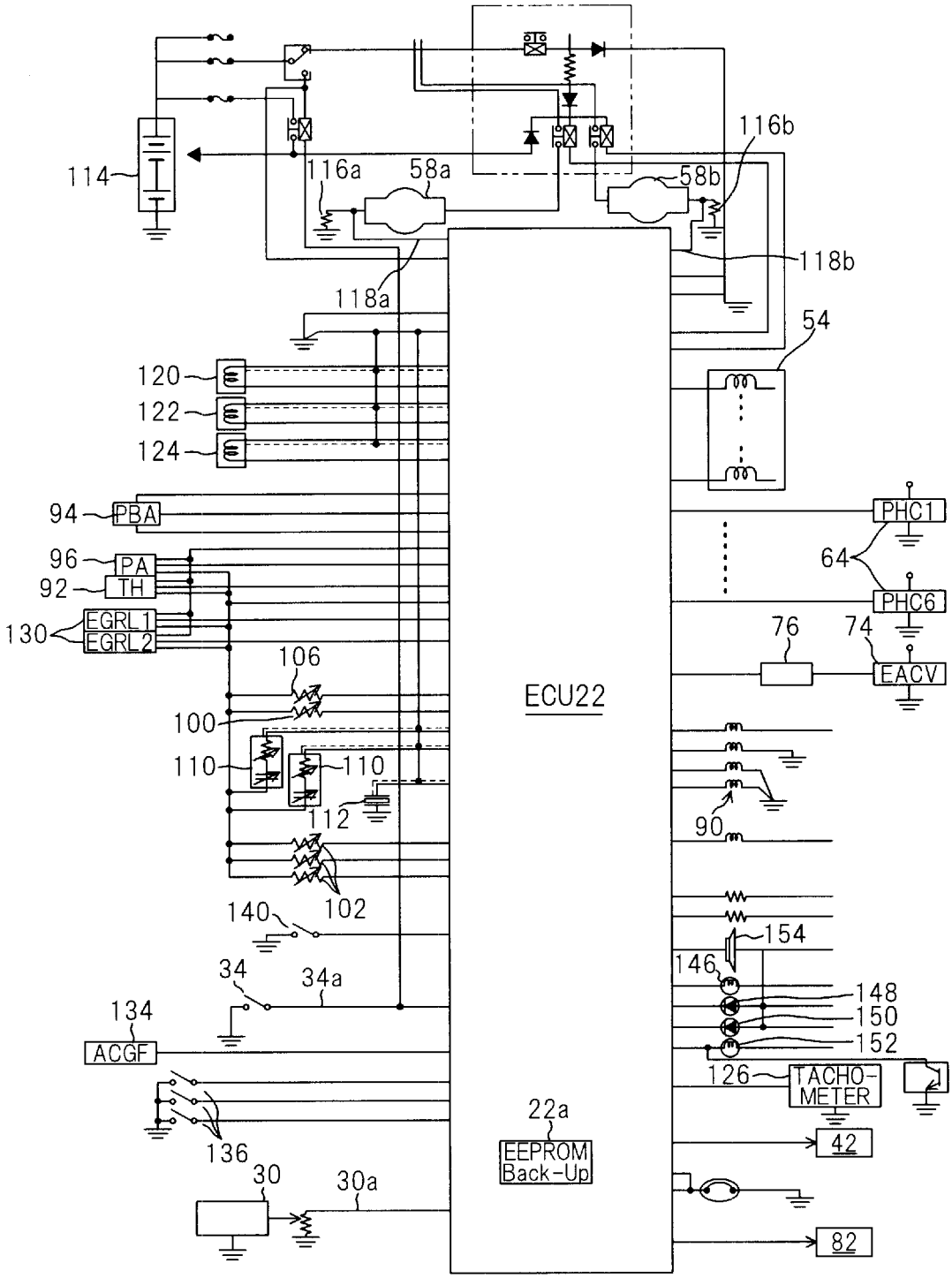
FIG. 4 is a block diagram setting out the particulars of inputs/outputs to and from the electronic control unit (ECU) shown in FIG. 1.

The explanation of the outputs of the sensors and the inputs/outputs to/from the ECU 22 will be continued with reference to FIG. 4. Some sensors and signals lines do not appear in FIG. 3.

The motors of the fuel pumps 58*a* and 58*b* are connected to an onboard battery 114 and detection resistors 116*a* and 116*b* are inserted in the motor current supply paths. The voltages across the resistors are input to the ECU 22 through signal lines 118*a* and 118*b*. The ECU 22 determines the amount of current being supplied to the motors from the voltage drops across the resistors and uses the result to discriminate whether any abnormality is present in the fuel pumps 58*a* and 58*b*.

TDC (top dead center) sensors 120 and 122 and a crank angle sensor 124 are installed near the engine crankshaft for producing and outputting to the ECU 22 cylinder discrimination signals, angle signals near the top dead centers of the pistons, and a crank angle signal once every 30 degrees. The ECU 22 calculates the engine speed NE from the output of the crank angle sensor. Lift sensors 130 installed near the EGR control valves 90 produce and send to the ECU 22 signals related to the lifts (valve openings) of the EGR control valves 90.

The output of the F terminal (ACGF) 134 of an AC generator (not shown) is input to the ECU 22. Three hydraulic switches 136 installed in the hydraulic circuit (not shown) of the variable valve timing system 84 produces and outputs to the ECU 22 a signal related to the detected hydraulic pressure. A hydraulic switch installed in the hydraulic circuit (not shown) of the engine 16 produces and outputs to the ECU 22 a signal related to the detected hydraulic pressure.

The ECU 22, which is composed of a microcomputer as mentioned earlier, is equipped with an EEPROM (electrically erasable and programmable read-only memory) 22*a* for back-up purposes. The ECU 22 uses the foregoing inputs to carry out processing operations explained later. It also turns on a PGM lamp 146 when the PGM (program/ECU) fails, an overheat lamp 148 when the engine 16 overheats, a hydraulic lamp 150 when the hydraulic circuit fails and an ACG lamp 152 when the AC generator fails. Together with lighting these lamps it sounds a buzzer 154. Explanation will not be made with regard to other components appearing in FIG. 4 that are not directly related to the substance of this invention.

The operation of the illustrated idling speed control system for an outboard motor will now be explained.

Figure 5:
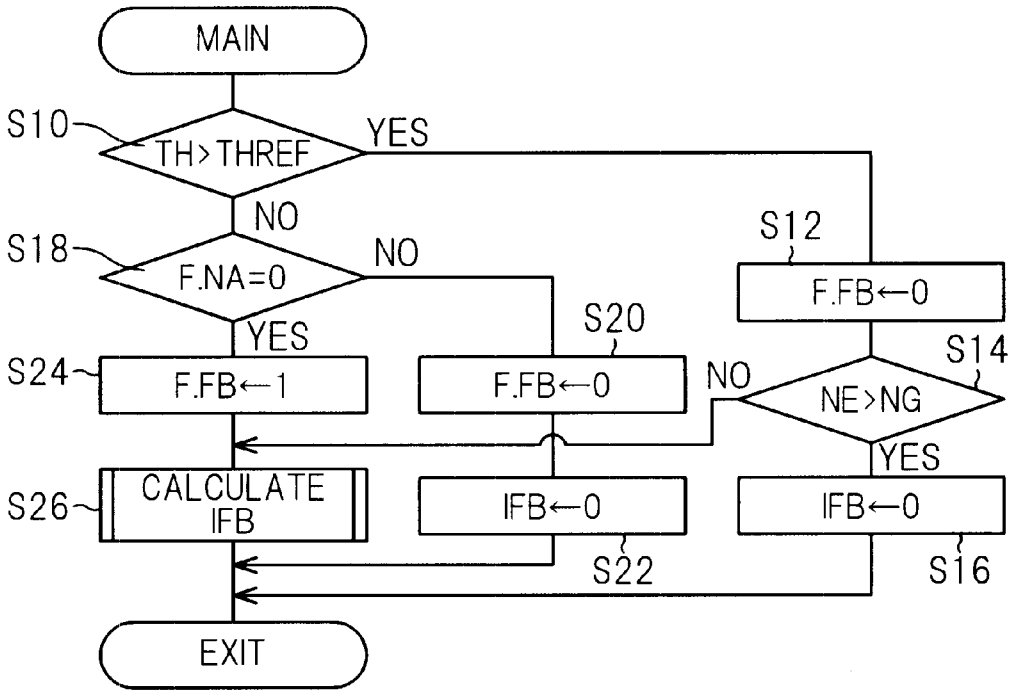
FIG. 5 is a main flow chart showing the sequence of operations for calculating a current command value for a secondary air control valve (a value representing a desired amount of secondary air) during operation of the idling speed control system for the engine of the motor shown in FIG. 1.

FIG. 5 is a main flow chart showing the sequence of operations of the system. The illustrated program is activated once every 40 msec, for example.

In S10 it is checked whether the detected throttle opening TH is equal to or greater than a prescribed opening THREF (at or near zero). In other words, it is discriminated whether or not the engine 16 is in the idling region. When the result is YES, the program goes to S12 in which the bit of a flag F.FB is reset to zero. Resetting the bit of the flag F.FB to zero indicates that no feedback control of the idling speed (i.e., the engine speed control during idling) is to be conducted.

Next, in S14, it is checked whether the detected engine speed NE is greater than a prescribed engine speed NG (e.g., 900 rpm). When the result is YES, the program goes to S16, in which a current command value IFB (more precisely, the current command value during idling speed feedback control) is set to zero. In this way, the desired amount of supplied secondary air is expressed as a current command value for the EACV 74. Since secondary air is therefore supplied to the cylinder combustion chambers in an amount proportional to the current command value, the quantity of fuel injection is increased/reduced proportionally to increase/reduce the engine speed (rpm). More specifically, the inflow of secondary air changes the pressure in the intake pipe in the same way that opening/closing the throttle does and, therefore, the quantity of fuel injection and the engine speed are increased/decreased in proportion.

When the result in S10 is NO and it is found that the engine 16 is in the idling region, the program goes to S18, in which it is checked whether the bit of a flag F.NA is reset to zero. The setting/resetting of the bit of the flag F.NA is conducted by a separate routine (not shown in the drawings), which resets the bit to zero when the detected engine speed NE is at or below feedback execution speed NA.

Figure 6:
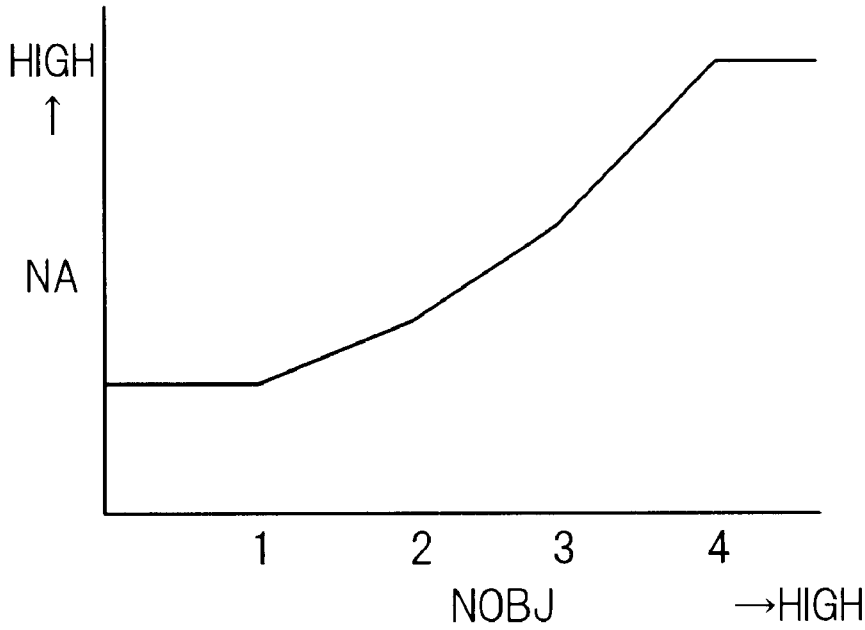
FIG. 6 is a graph for explaining the characteristic of a feedback execution speed NA referred to in the flow chart of FIG. 5.

FIG. 6 is a graph for explaining the characteristic of the feedback execution speed NA. The feedback execution speed NA is set lower than the prescribed engine speed NG and defined so as to increase in proportion to the desired idling speed (hereinafter referred to as desired idling speed NOBJ), which will be explained later.

When the result in S18 is NO, i.e., when the detected engine speed NE is found to be relatively high, the program goes to S20, in which the bit of the flag F.FB is reset to zero, and to S22, in which the current command value IFB is set to zero. When the result in S18 is YES, i.e., when the engine speed NE is found to be relatively low, the program goes to S24, in which the bit of the flag F.FB is set to 1. The setting of the bit of the flag to 1 indicates that feedback control is to be executed. Next, in S26, the current command value IFB is calculated. It is also calculated when the result in S14 is NO.

Figure 7:
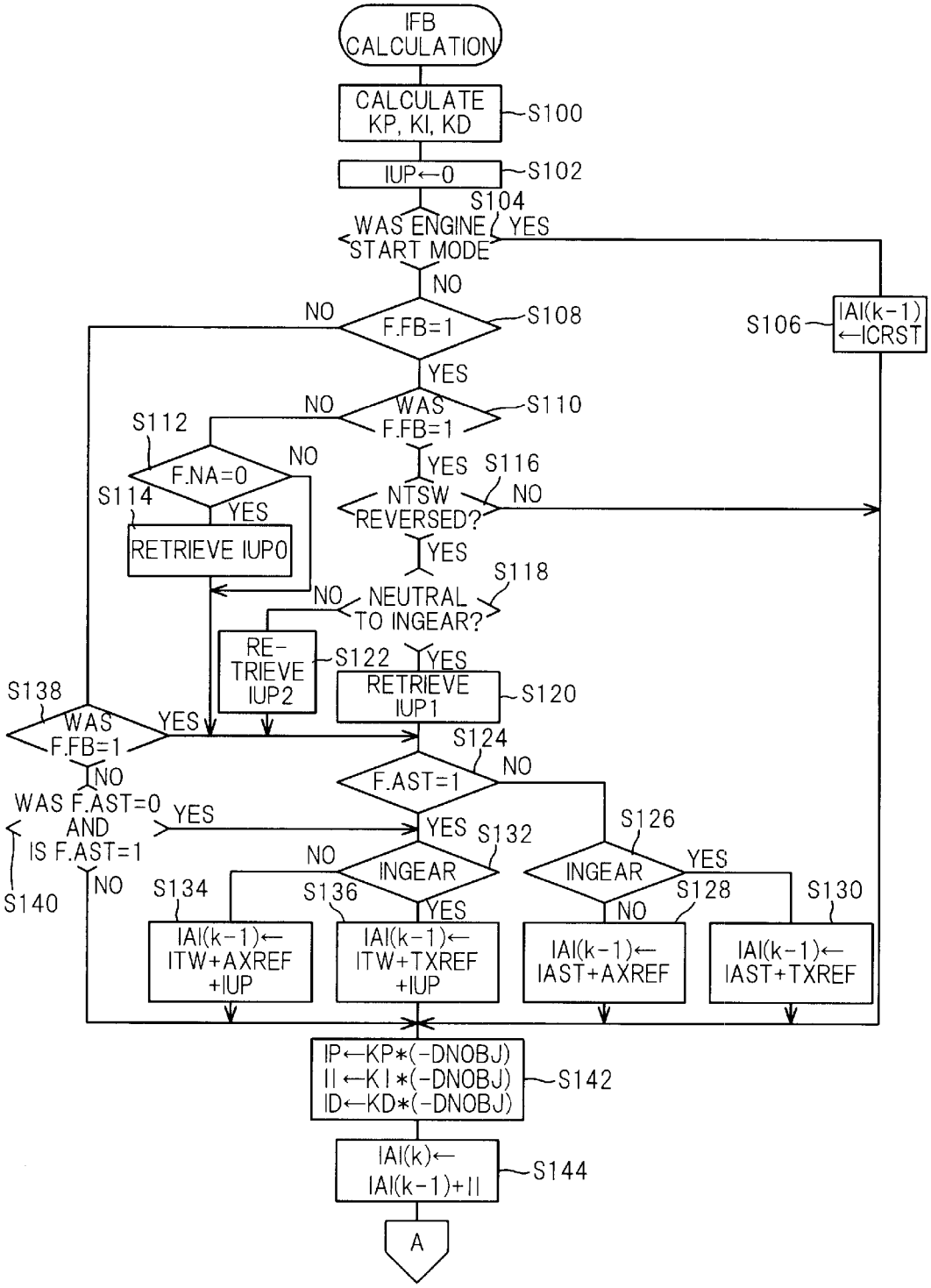
FIG. 7 is the former half of a subroutine flow chart showing the sequence of operations for calculating the current command value IFB in the flow chart of FIG. 6.
Figure 8:
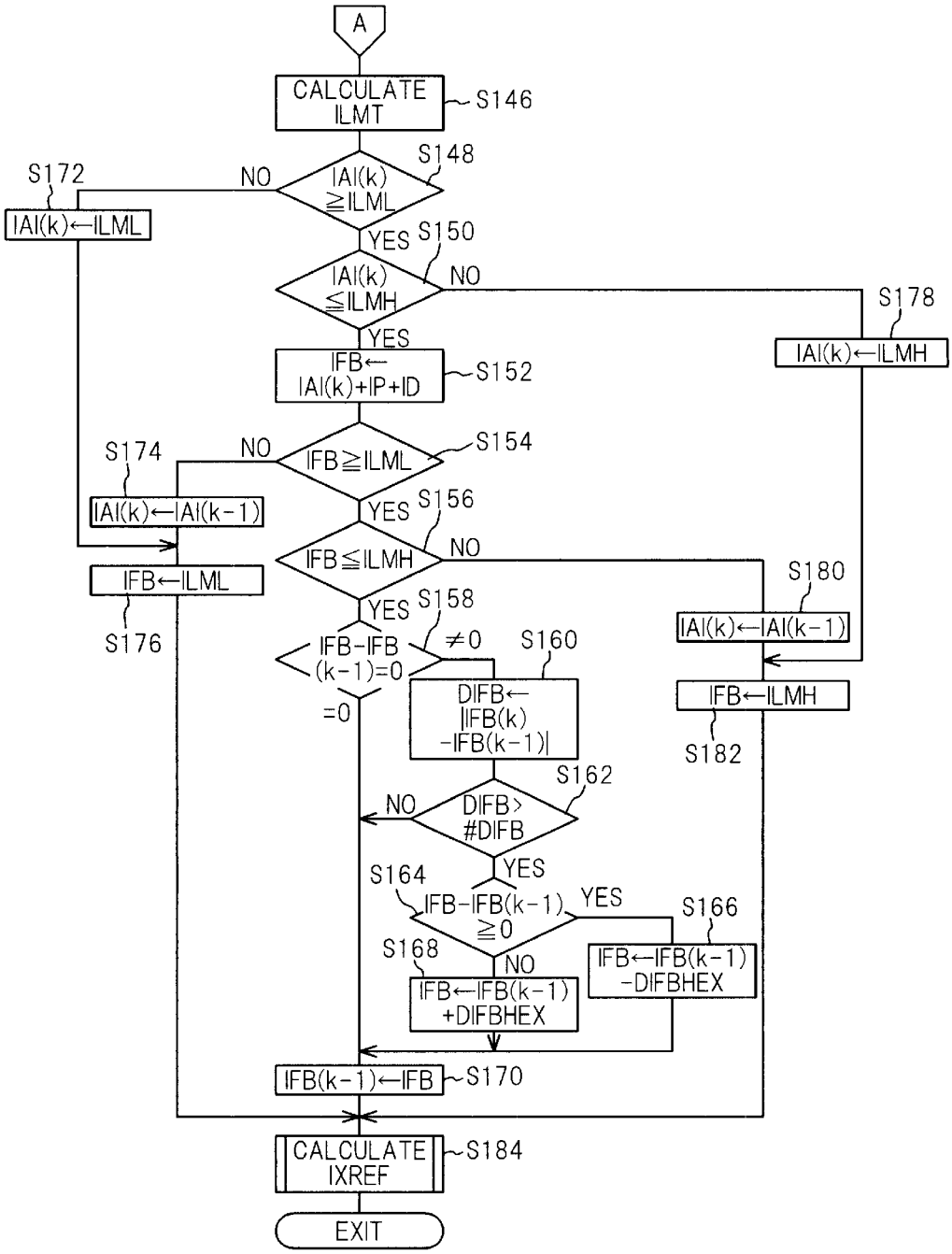
FIG. 8 is the latter half of the subroutine flow chart showing the sequence of operations for calculating the current command value IFB in the flow chart of FIG. 6.

FIGS. 7 and 8 show a subroutine flow chart of the sequence of operations for calculating the current command value IFB in S26 of the flow chart of FIG. 6.

In S100, correction coefficients KP, KI and KD are calculated. The program then goes to S102, in which an excessive change correction value IUP is set to zero.

Next, in S104, it is detected whether the engine 16 was in start mode in the preceding cycle, i.e., during the preceding program cycle of the flow chart of FIG. 5. This is determined by checking whether the detected engine speed NE had reached full-firing speed. When the result in S104 is YES, the program goes to S106, in which a base current command value IAI is set to a prescribed engine start time value ICRST.

When the result in S104 is NO, the program goes to S108, in which it is checked whether the bit of the flag F.FB is set to 1. When the result is YES, the program goes to S110, in which it is checked whether the bit of the flag F.FB was also 1 in the preceding cycle. When the bit was first set to 1 in the current cycle, the result in S110 is NO and the program goes to S112, in which it is checked whether the bit of the flag F.NA is zero.

When the result in S112 is YES, the detected engine speed NE is below the feedback execution speed NA and the program therefore goes to S114, in which the excessive change correction value IUPO is determined by retrieval from an IUPO table (whose characteristic is not shown) using the intake air temperature TA as the address. S114 is skipped when the result in S112 is NO.

When the result in S110 is YES, meaning that feedback control was also executed in the preceding cycle, the program goes to S116, in which it is checked whether the output of the neutral switch 34 (illustrated as "NTSW" in the figure) reversed, i.e., whether the shift lever 32 was shifted from Neutral to Forward (or Reverse) or from Forward (or Reverse) to Neutral. When the result in S116 is YES, the program goes to S118, in which it is checked whether a shift was made from Neutral to an INGEAR state, i.e., from Neutral to Forward (or Reverse).

When the result in S118 is YES, the excessive change correction value IUP1 is retrieved from an IUP1 table (whose characteristic is not shown) using the detected intake air temperature TA as an address. When the result in S118 is NO, the program goes to S122, in which the excessive change correction value IUP2 is retrieved from an IUP2 table (whose characteristic is not shown) using the intake air temperature TA as an address. The excessive change correction values of the tables IUPn are defined so that IUP0>IUP1>IUP2.

This is because IUP0, IUP1, and IUP2 are respectively tables from which the excessive change correction value IUP is retrieved when the engine speed is on the decline, during load, and during no load. The values of the IUPO table must therefore be defined large to bring the engine speed NE back up to the proper level and the values of the IUP1 table need to be set larger than those of the IUP2 table.

Next, in S124, it is checked whether the bit of a flag F.AST is set to 1. The bit of this flag is set to one in a separate routine (not shown) in the post-start state of the engine 16. The "post-start state" of the engine 16 is defined as that when the detected engine speed NE has reached the full-firing speed (500 rpm).

When the result in S124 is NO, the program goes to S126, in which it is checked whether the shift lever 32 is INGEAR, i.e., whether it has been put in Forward (or Reverse). When the result is NO, the program goes to S128, in which the sum of a correction value IAST and an idling learning control value (desired amount of secondary air required during idling) AXREF (explained later) is defined as the preceding-cycle base value IAI(k−1).

When the result in S126 is YES, the program goes to S130, in which the sum of the correction value (air amount required immediately after start) IAST and a trolling learning control value (desired amount of secondary air required during trolling) TXREF (explained later) is defined as the preceding-cycle base value IAI(k−1).

As termed in this specification and the drawings, "trolling" means moving of the boat 12 forward or backward with the shift lever 32 put in Forward (or Rearward) and the throttle at full closed. In other words, it means moving of the boat 12 forward or backward at very low speed with the engine 16 in the idling state.

As used in this specification and the drawings, the suffix k indicates sampling time in discrete-time series, particularly program loop time in the flow chart of FIG. 5. Still more specifically, a value suffixed with (k) is that during the current cycle and a value suffixed with (k−1) is that during the preceding cycle. For simplicity, the suffix (k) is omitted except when necessary to avoid confusion.

When the result in S124 is YES, the program goes to S132, in which it is checked whether the shift lever 32 is INGEAR, i.e., whether it has been put in Forward (or Reverse). When the result in S132 is NO, the program goes to S134, in which the sum of a coolant correction value ITW, the idling learning control value (desired amount of secondary air required during idling) AXREF (explained later) and the excessive change correction value IUP is defined as the preceding-cycle base value IAI(k−1).

When the result in S132 ins YES, the program goes to S136, in which the sum of the coolant correction value ITW, the trolling learning control value (desired amount of secondary air required during trolling) TXREF (explained later)

and the excessive change correction value IUP is defined as the preceding-cycle base value IAI(k−1).

The idling learning control value (desired amount of secondary air required during idling) AXREF and trolling learning control value (desired amount of secondary air required during trolling) TXREF are assigned the generic symbol IXREF. Calculation of the learning control values is explained later.

When the result in S108 is NO, such as when the program passes from S14 to S26 in the flow chart of FIG. 5, the program goes to S138, in which it is checked whether the bit of the flag F.FB was set to 1 in the preceding cycle. When the result in S138 is YES, i.e., when the bit of the flag F.FB has not been reset to zero continuously but only in the current cycle, the program goes to S124. When the result in S138 is NO, the program goes to S140, in which it is checked whether the bit of the flag F.AST was zero in the preceding cycle and changed to 1 in the current cycle. When the result in S138 is YES, the program goes to S132.

The program next goes to S142, in which the deviation -DNOBJ between the detected engine speed NE and the desired idling speed NOBJ (explained later) is calculated and multiplied by the aforesaid correction coefficients to obtain a proportional correction value IP, integral correction value II and derivative correction value ID. The same applies when the processing of S106 has been carried out and when the result in S140 is NO.

Next, in S144, the calculated integral correction value II is added to the preceding-cycle base current command value IAI(k−1) to obtain the current-cycle base current command value IAI(k). Next, in S146 (FIG. 8), limit values ILMT, more specifically a lower limit value ILML and an upper limit value ILMH, are retrieved. Next, in S148, it is checked whether the calculated base current command value IAI(k) is equal to or greater than the retrieved lower limit value ILML. When the result is YES, the program goes to S150, in which it is checked whether the calculated base current command value IAI(k) is equal to or less than the retrieved upper limit value ILMH.

When the result in S150 is YES, the program goes to S152, in which the proportional correction value IP and the derivative correction value ID are added to the calculated base current command value IAI(k) and the sum obtained is defined as the current command value IFB. Next, in S154, it is checked whether the calculated current command value IFB is equal to or greater than the lower limit value ILML. When the result is YES, the program goes to S156, in which it is checked whether the calculated current command value IFB is equal to or less than the upper limit value ILMH.

When the result in S156 is YES, the program goes to S158, in which it is checked whether the value obtained by subtracting the preceding-cycle current command value IFB (k−1) from the calculated current-cycle current command value IFB is zero, i.e., whether or not there is a difference between them.

Figure 9:
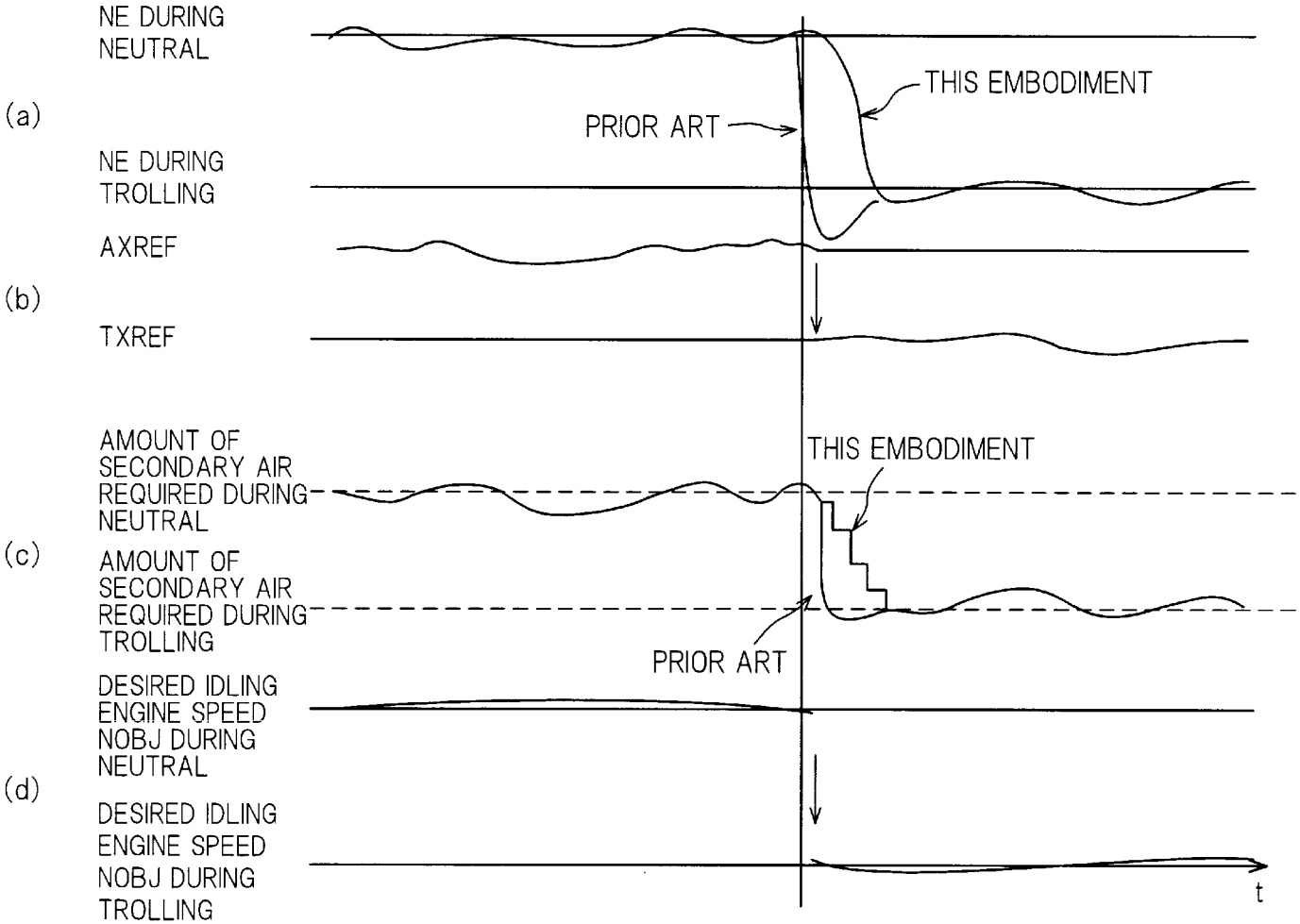
FIG. 9 is a time chart for explaining, inter alia, processing conducted in the subroutine flow chart of FIG. 7.

The explanation of the flow chart of FIG. 8 will be interrupted at this point to explain this control with reference to the time chart of FIG. 9.

As shown at (a) in FIG. 9 and as was pointed out earlier, when the shift lever 32 is shifted from Neutral to Forward (or reverse), the engine speed NE falls, for instance, from 750 rpm to 650 rpm. In the conventional system, the abrupt change in engine speed this causes produces an unpleasant feeling.

In this embodiment, therefore, learning control values are utilized and, as shown (b) in the same figure, the learning control value is changed according to the shift position. Therefore, as shown at (a) in the figure, the engine speed NE can be smoothly varied and stable low-speed operation can be achieved during trolling.

In addition, as shown at (c) in the figure, when the shift lever 32 is shifted from Neutral to a trolling position (Forward or Reverse), the current command value IFB is corrected in prescribed increments to enable even smoother variation of the engine speed NE. As shown at (d) in the figure, the desired idling speed NOBJ is also changed according to the shift position. This will be explained in further detail later.

The explanation of the flow chart of FIG. 8 will be continued. When a difference is found in S158, the program goes to S160, in which the absolute value of the difference DIFB between the current cycle and preceding cycle is calculated, and to S162, in which it is checked whether the calculated difference DIFB is greater than a prescribed value #DIFB, i.e., whether or not the difference is large. When the result is YES, the program goes to S164, in which it is checked whether the difference between the current-cycle and preceding cycles is zero or greater, i.e., whether or not it is on the increase.

When the result in S164 is YES, the program goes to S166, in which the value obtained by subtracting a prescribed value DIFBHEX from the preceding-cycle current command value IFB(k−1) is defined as IFB. When the result in S164 is NO, the program goes to S168, in which the value obtained by adding the prescribed value DIFB HEX to the preceding-cycle current command value IFB(k−1) is defined as IFB. Next, in S170, in preparation for the calculation in the next cycle, the calculated value IFB is defined as the preceding-cycle current command value IFB (k−1).

When no difference is found in S158, the program goes straight to S170. When the result in S148 is NO, the program goes to S172, in which the retrieved lower limit value ILML is defined as the current-cycle base current command value IAI(k). When the result in S154 is NO, the program goes to S174, in which the preceding-cycle base current command value IAI(k−1) is defined as the current-cycle value IAI(k), and to S176, in which the lower limit value ILML is defined as the current command value IFB.

When the result in S150 is NO, the program goes to S178, in which the retrieved upper limit value ILMH is defined as the current-cycle base current command value IAI(k). When the result in S156 is NO, the program goes to S180, in which the preceding-cycle base current command value IAI(k−1 is defined as the current-cycle value IAI(k), and to S182, in which the upper limit value ILMH is defined as the current command value IFB.

The program next goes to S184, in which the learning control value IXREF is calculated. As was mentioned earlier, IXREF is a generic symbol for the idling learning control value AXREF and trolling learning control value TXREF.

Figure 10:
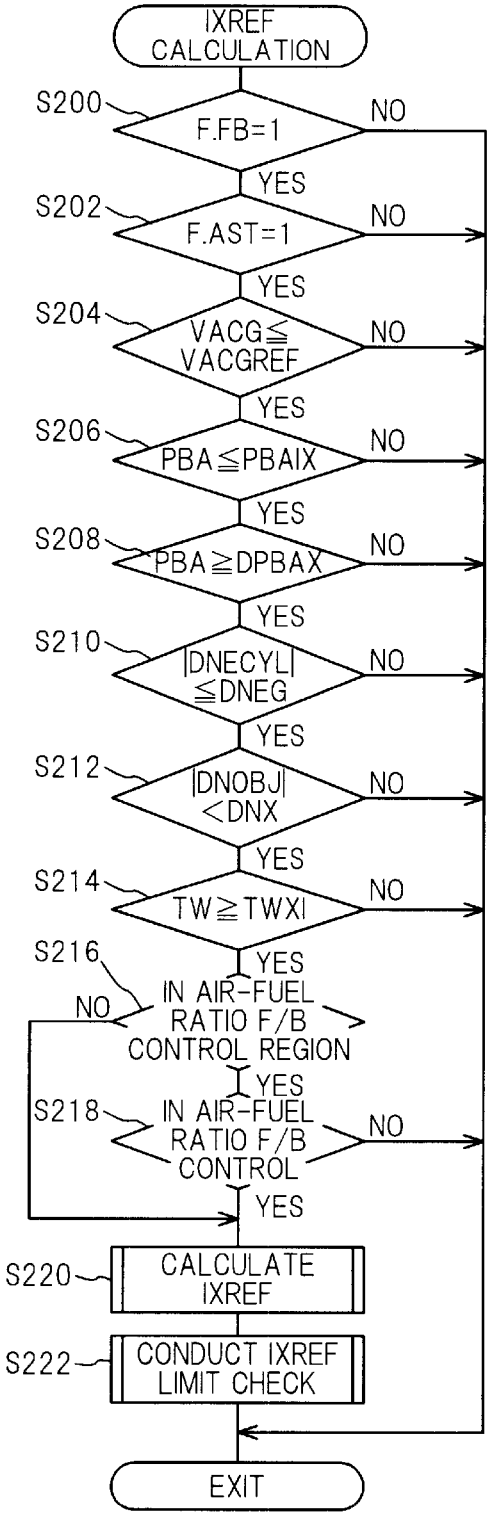
FIG. 10 is subroutine flow chart showing the sequence of operations for calculating the learning control value IXREF in the subroutine flow chart of FIG. 7.

FIG. 10 is subroutine flow chart showing the sequence of operations for calculating the learning control value IXREF.

In S200, it is checked whether the bit of the flag F.FB is set to 1, i.e., whether the system is in feedback mode. When the result is NO, the remaining steps in of the subroutine are skipped.

Next, in S202, it is checked whether the bit of the flag F.AST is set to 1, i.e., whether the system is in post-start mode. When the result is NO, the remaining steps are skipped. When the result is YES, the program goes to S204, in which it is checked whether the voltage VACG at the F terminal 134 of the AC generator is equal to or less than a prescribed value VACGREF. When the result is NO, the remaining steps are skipped.

When the result in S204 is YES, the program goes to S206, in which it is checked whether the detected absolute pressure PBA in the air intake pipe is equal to or less than a prescribed value PBAIX. When the result is NO, the remaining steps are skipped. When the result is YES, the program goes to S208, in which it is checked whether the detected absolute pressure PBA in the air intake pipe is equal to or greater than a prescribe value DPBAX. When the result is NO, the remaining steps are skipped.

When the result in S208 is YES, the program goes to S210, in which the variation value DNECYCL of the detected engine speed NE during a prescribed combustion cycle (e.g., the first combustion cycle) is calculated as an absolute value and checked as to whether it is equal to or less than a prescribed value DNEG. When the result is NO, the remaining steps are skipped. When the result is YES, the program goes to S212, in which the variation value DNOBJ of the desired idling speed NOBJ is calculated as an absolute value and checked as to whether it is less than a prescribed value DNX. When the result is NO, the remaining steps are skipped.

When the result in S212 is YES, the program goes to S214, in which it is checked whether the detected engine coolant temperature TW is equal to or greater than a prescribed value TWX1. When the result is NO, the remaining steps are skipped. When the result is YES, the program goes to S216, in which, by referring to a suitable flag in a separate air-fuel ratio control routine (not shown), for example, it is checked whether the system is in an air-fuel ratio feedback region based on the outputs of the $O_2$ sensors 110. When the result is YES, the program goes to S218, in which it is checked by a similar method whether air-fuel ratio feedback control is in effect. When the result in S216 is NO, S218 is skipped.

When the result in S218 is NO, the remaining steps are skipped. When it is YES, the program goes to S220, in which the learning control values IXREF are calculated.

Figure 11:
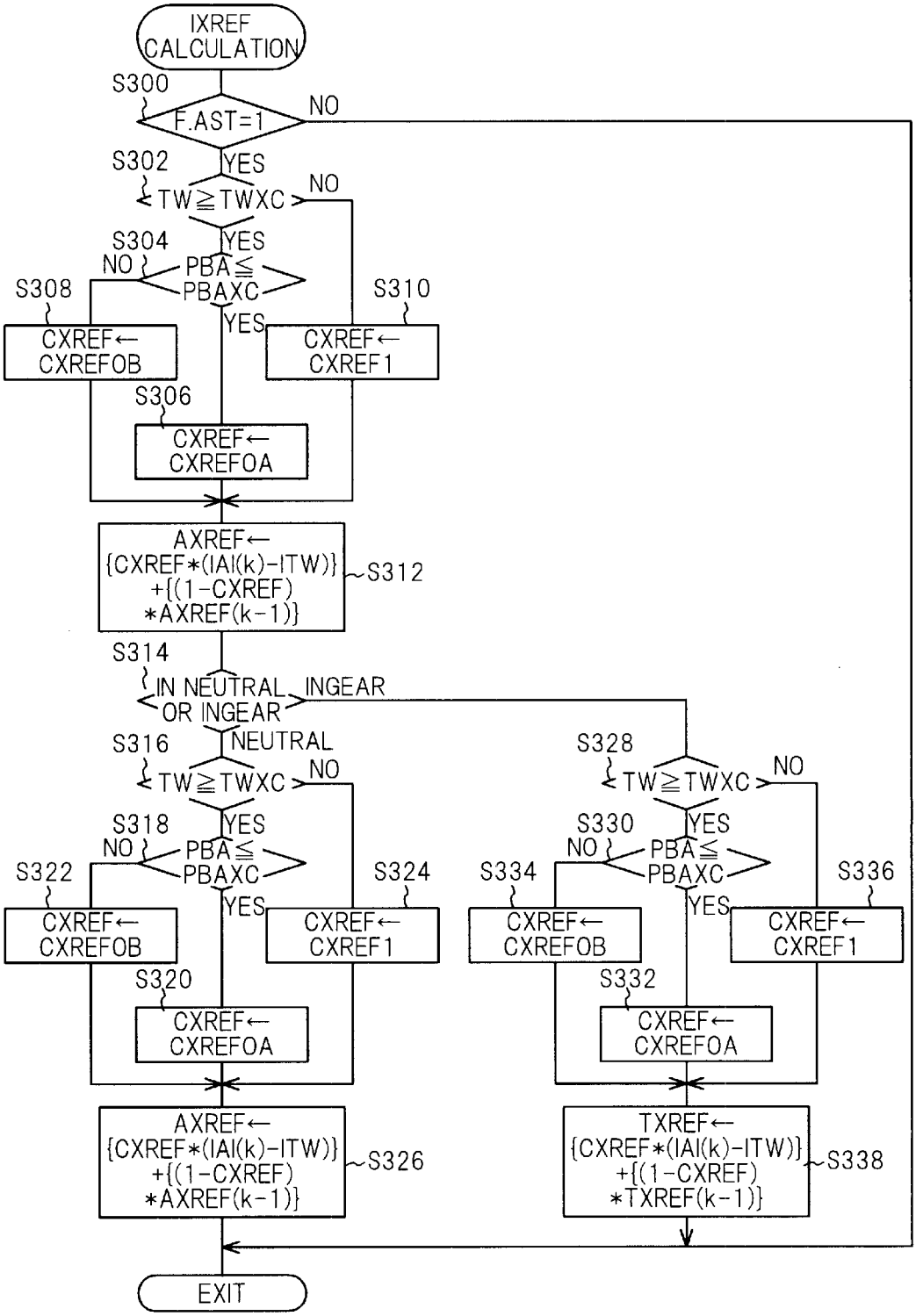
FIG. 11 is a subroutine flow chart showing the sequence of operations for calculating the learning control value IXREF in the subroutine flow chart of FIG. 10.

FIG. 11 is a subroutine flow chart showing the sequence of operations for this calculation.

In S300, it is checked whether the bit of the flag F.AST is set to 1, i.e., whether the system is in post-start mode. When the result is NO, the remaining steps are skipped. When the result in is YES, the program goes to S302, in which it is checked whether the detected engine coolant temperature TW is equal to or greater than a prescribed value TWXC.

When the result in S302 is YES, meaning that the coolant temperature is high, the program goes to S304, in which it is checked whether the detected manifold absolute pressure PBA in the air intake pipe is equal to or less than a prescribed value PBAXC. When the result is YES, meaning that the load is low, the program goes to S306, in which the detected engine coolant temperature TW and the manifold absolute pressure PBA in the air intake pipe are used as address data for retrieving from a table, whose characteristic is shown in FIG. 12, a value CXREFOA that is defined as a smoothing coefficient CXREF.

Figure 12:
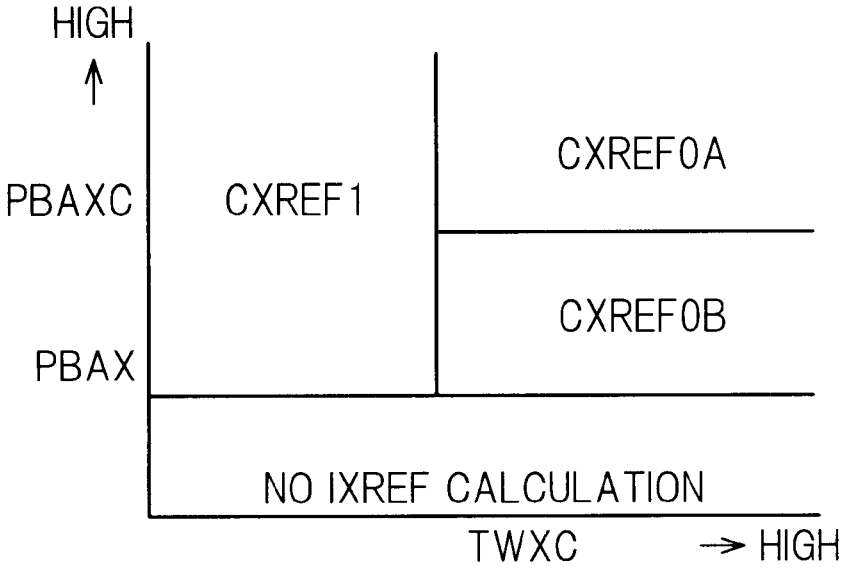
FIG. 12 is a graph for explaining the characteristic of a smoothing coefficient used to calculate the learning control value in the subroutine flow chart of FIG. 10.

When the result in S304 is NO, meaning the load is high, the program goes to S308, in which, similarly, the detected engine coolant temperature TW and the absolute pressure PBA in the air intake pipe are used as address data for retrieving from the table whose characteristic is shown in FIG. 12 a value CXREFOB that is defined as the smoothing coefficient CXREF.

When the result in S302 is NO, meaning that the coolant temperature is low, the program goes to S310, in which, similarly, the detected engine coolant temperature TW and the manifold absolute pressure PBA in the air intake pipe are used as address data for retrieving from the table whose characteristic is shown in FIG. 12 a value CXREF1 that is defined as the smoothing coefficient CXREF.

Next, in S312, the calculated smoothing coefficient and the base value etc. mentioned earlier are used to calculate the post-engine-start idling learning control value AXREF in accordance with the formula shown. The learning control value is thus calculated so as to smooth or temper the base current command value LIA (more specifically, the difference between it and the coolant correction value ITW) calculated for eliminating deviation between the desired idling speed NOBJ and the detected engine speed NE. In other words, the learning control value is calculated so that the desired amount of secondary air (required air amount) produces the desired idling speed NOBJ.

Next, in S314, it is checked whether the shift lever 32 is shifted to Neutral or to Forward (or Reverse). When it is found to be shifted to Neutral, the processing operations of S316 to S324 are carried out to calculate the smoothing coefficient CXREF by retrieval from a table whose characteristic is similar to that shown in FIG. 12. The program then goes to S326, in which the post-engine-start idling learning control value AXREF is similarly calculated. When the shift lever 32 is found to be shifted to Forward (or Reverse) in S314, the processing operations of S328 to S336 are carried out to calculate the smoothing coefficient CXREF by retrieval from a table whose characteristic is similar to that shown in FIG. 12

The program then goes to S338, in which the post-engine-start trolling learning control value TXREF is similarly calculated. The learning control values AXREF and TXREF calculated in the foregoing manner are stored in the EEPROM 22*a,* where they are retained even after the engine 16 has been stopped.

The explanation of the flow chart of FIG. 10 will be continued. Next, in S222, the calculated learning control value is subjected to a limit check.

Figure 13:
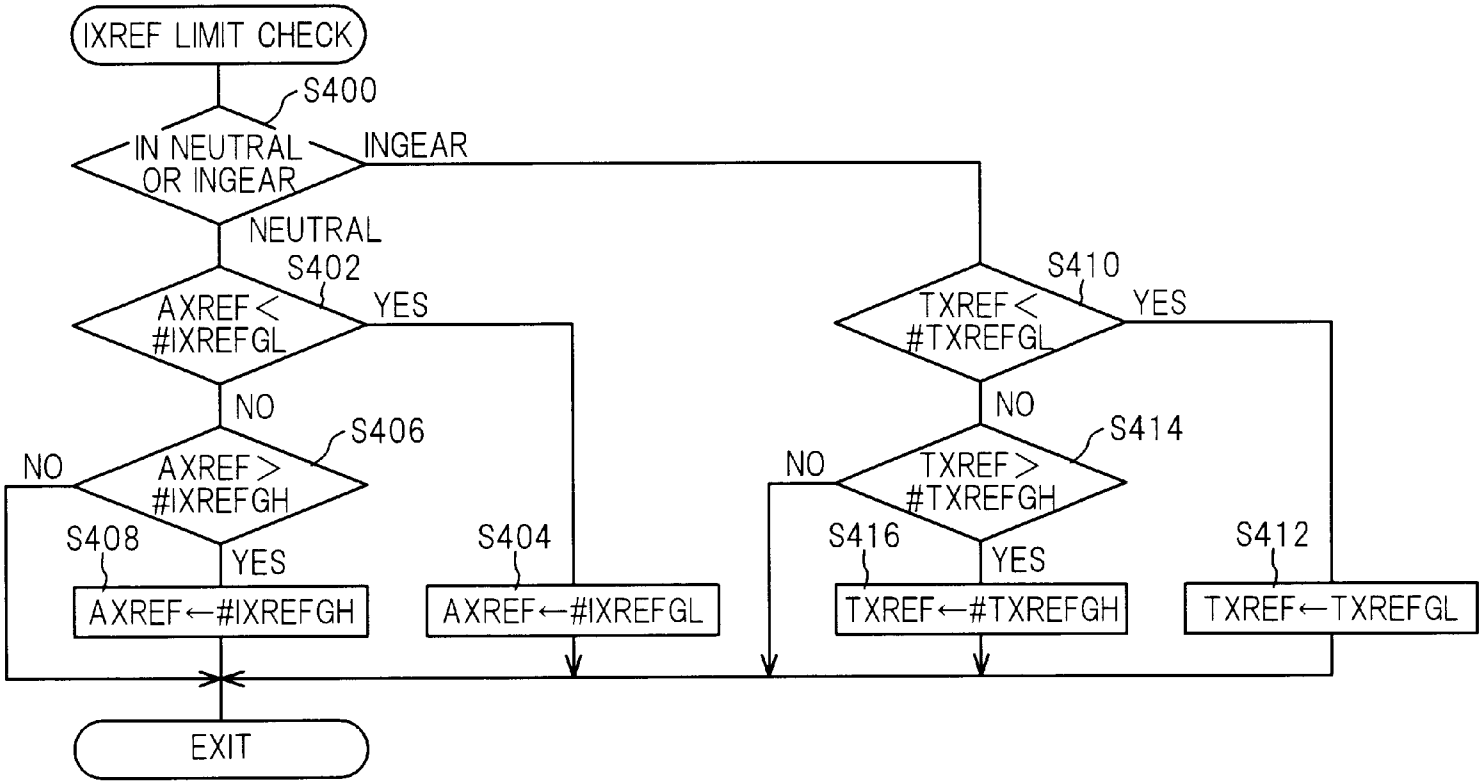
FIG. 13 is a subroutine flow chart showing the sequence of operations for limit-check processing of the learning control value IXREF in the subroutine flow chart of FIG. 10.

FIG. 13 is a subroutine flow chart showing the sequence of operations for this purpose.

In S400, it is checked whether the shift lever 32 is in Neutral or in Forward (or Reverse). When it found to be in Neutral, the program goes to S402, in which it is checked whether the calculated idling learning control value AXREF is less than a prescribed lower limit value #IXREFGL. When the result is YES, the program goes to S404, in which the lower limit value #IXREFGL is defined as the learning control value.

When the result in S402 is NO, the program goes to S406, in which it is checked whether the calculated idling learning control value AXREF is greater than an upper limit value #IXREFGH. When the result is YES, the program goes to S408, in which the upper limit value #IXREFGH is defined as the learning control value. When the result is NO, S408 is skipped.

When the result in S400 is INGEAR, i.e., when it is found that the shift lever 32 is shifted to Forward (or Reverse), the program goes to S410, in which it is checked whether the calculated trolling learning control value TXREF is less than a lower limit value #TXREFGL. When the result is YES, the program goes to S412, in which the lower limit value #TXREFGL is defined as the learning control value.

When the result in S410 is NO, the program goes to S414, in which it is checked whether the calculated trolling learning control value TXREF is greater than an upper limit value #TXREFGH. When the result is YES, the program goes to S416, in which the upper limit value #TXREFGH is defined as the learning control value. When the result in S414 is NO, S416 is skipped.

The calculation of the desired idling speed NOBJ will now be explained.

Figure 14:
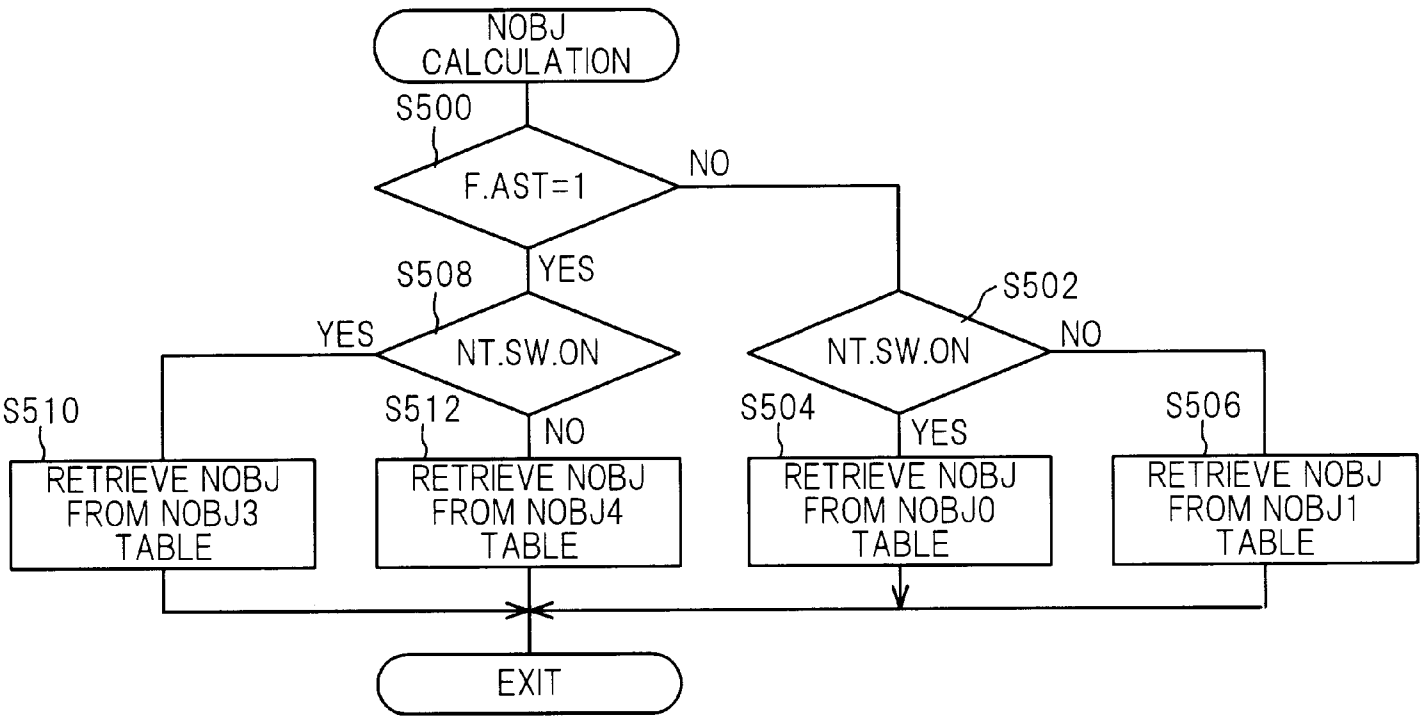
FIG. 14 is a flow chart showing the sequence of operations for calculating a desired idling speed during operation of the idling speed control system for the engine of the motor shown in FIG. 1.

FIG. 14 is a subroutine flow chart showing the sequence of operations for this calculation.

In S500, it is checked whether the bit of the flag F.AST is set to 1. When the result is NO, meaning that the engine is in start mode, the program goes to S502, in which it is checked whether the neutral switch 34 is outputting an ON signal, i.e., whether the shift lever 32 is shifted to Neutral. When the result in S502 is YES and the shift lever 32 is found to be shifted to Neutral, the program goes to S504, in which the desired idling speed NOBJ is calculated by retrieval from a table (characteristic) representing NOBJ0 in FIG. 15 using the detected engine coolant temperature TW and engine speed NE as address data.

Figure 15:
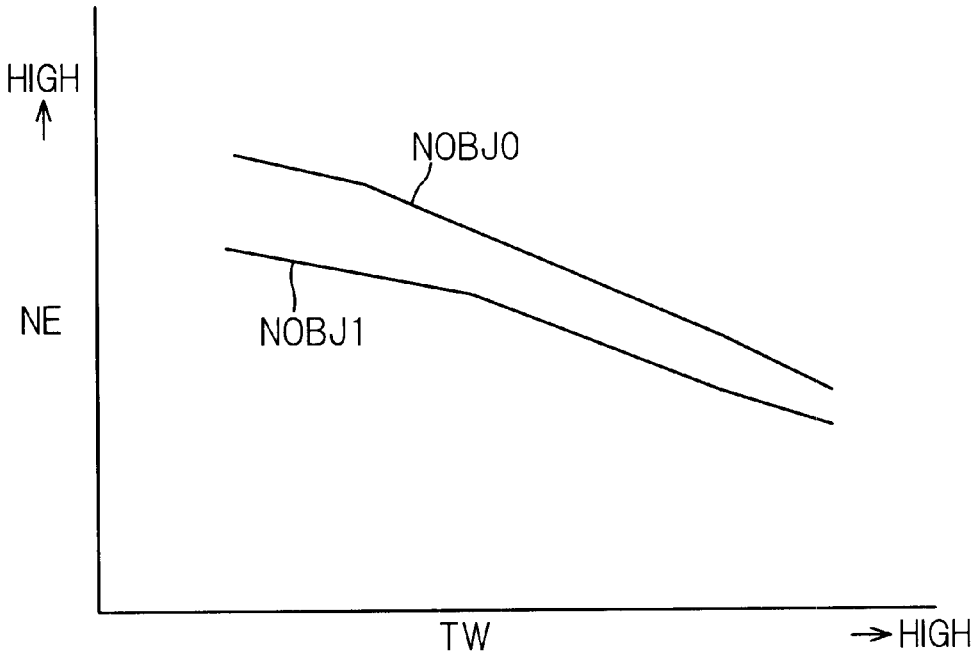
FIG. 15 is a graph for explaining a characteristic of the desired idling speed calculated in the flow chart of FIG. 14.

When the result in S502 is NO and the shift lever 32 is found to be shifted to Forward (or Reverse), the program goes to S506, in which the desired idling speed NOBJ is calculated by retrieval from a table (characteristic) representing NOBJ 1 in FIG. 15 using the detected engine coolant temperature TW and engine speed NE as address data.

When the result in S500 is YES, meaning that the engine is in start mode, the program goes to S508, in which it is checked whether the neutral switch 34 is outputting an ON signal. When the result is YES, the program goes to S510, in which the desired idling speed NOBJ is calculated by retrieval from a table (characteristic) like the table representing NOBJ0 in FIG. 15 using the detected engine coolant temperature TW and engine speed NE as address data.

When the result in S508 is NO and the shift lever 32 is found to be shifted to Forward (or Reverse), the program goes to S512, in which the desired idling (trolling) speed NOBJ is calculated by retrieval from a table (characteristic) like the table representing NOBJ1 in FIG. 15 using the detected engine coolant temperature TW and engine speed NE as address data.

As explained in the foregoing, in this embodiment the desired idling (or trolling) speed NOBJ is changed according to the shift position in the start-state of the engine 16 and as shown in FIG. 9(*d*). As a result, the desired idling (or trolling) speed can be reliably determined in accordance with the engine operating condition and the shift position.

In addition, since the system controls the amount of secondary air (required air amount) so as to achieve the determined desired (trolling) idling speed, accurate idling speed control can be effected to achieve steady idling speed even if the clutch is operated (shifted), the propeller is replaced or the load changes owing to aged deterioration or the like. In addition, since the system can achieve a lower engine speed than the conventional system during trolling and the like, it is capable of enhancing fuel performance.

The embodiment is thus configured to have a system for controlling an idling speed for an outboard motor mounted on a boat 12 and equipped with an internal combustion engine 16 whose output is connected to a propeller 40 through a clutch 36 such that the boat is propelled forward or reverse when the clutch is changed to a neutral (Neutral) position to a forward (Forward) position or a reverse (Reverse) position, having: secondary air supplier 80 that supplies secondary air trough a passage (branch passage 72) that is connected to an air intake pipe 46 downstream of a throttle valve 50 and that is equipped with a secondary air control valve (EACV 74) such that amount of secondary air is supplied to the air intake pipe in response to an opening of the secondary air control valve; engine operating condition detecting means (crank angle sensor 124, manifold absolute pressure sensor 94, intake air temperature sensor 100, coolant temperature sensor 106, ECU 22, etc.) for detecting parameters indicative of operating conditions of the engine including at least an engine speed NE; engine start-state determining means (ECU 22) for determining engine start-state as to whether the engine has been started based on one of the detected parameters; desired value determining means (ECU 22) for determining a desired idling (or trolling) speed NOBJ and for determining a desired secondary air supply amount such that a deviation DNOB between the determined desired idling speed NOBJ and the detected engine speed NE decreases; and valve controlling means (ECU 22, actuator 76) for controlling the opening of the valve to a value that effects the desired secondary air supply amount; wherein the improvement comprising: the system includes: clutch position detecting means (ECU 22, S502, S508, S314) for detecting the position of the clutch; and wherein the desired value determining means determines the desired idling speed and the desired secondary air supply amount (the current command value IFB, more specifically the learning control value IXREF comprising the idling learning control value (desired amount of secondary air required during idling) AXREF and trolling learning control value (desired amount of secondary air required during trolling) TXREF) based on the determined engine start-state and the detected clutch position. (S500 to S512, S10 to S26, S100 to S184, S200 to S222, S300 to S338).

In the system, the desired value determining means learning-controls the determined desired secondary air supply amount (S312, S326, S338).

In the system, the desired value determining means learning-controls the determined desired secondary air supply amount such that the deviation between the desired idling speed and the detected engine speed decreases. Specifically it learning-controls the determined amount by smoothing the base current command value IAI (determined such that deviation DNOB between the determined desired idling speed NOBJ and the detected engine speed Ne decreases). more specifically by smoothing the difference between the base current command value IAI and the coolant correction value ITW (S312, S326, S338)

In the system, the desired value determining means determines to correct the desired secondary air supply amount by a prescribed amount such that the deviation DNOB between the desired idling speed NOBJ and the detected engine speed NE decreases, when the clutch position is changed. Specifically, it determines to correct the amount (i.e., the current command value IFB determined based on the base current command value IAI including the learning control value IXREF) by a prescribed amount (DIFBHEX) such that the deviation DNOB between the desired idling speed NOBJ and the detected engine speed NE decreases (S162 to S168).

Although the invention was explained with reference to an embodiment of an outboard motor, the invention is not limited in application to an outboard motor but can also be applied to an inboard motor.

Although the invention was explained with reference to an embodiment equipped not only with a secondary air supplier but also with a DBW (Drive-by-Wire) system for driving the throttle valve with an actuator, the DBW system is not an essential feature of the invention.

While the invention has thus been shown and described with reference to specific embodiments, it should be noted that the invention is in no way limited to the details of the described arrangements but changes and modifications may be made without departing from the scope of the appended claims.

What is claimed is:

1. A system for controlling an idling speed for an outboard motor mounted on a boat and equipped with an internal combustion engine whose output is connected to a propeller through a clutch such that the boat is propelled forward or reverse when the clutch is changed from a neutral position to a forward position or a reverse position, having:

secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve;

engine operating condition detecting means for detecting parameters indicative of operating conditions of the engine including at least an engine speed;

engine start-state determining means for determining engine start-state as to whether the engine has been started based on one of the detected parameters;

desired value determining means for determining a desired idling speed and for determining a desired secondary air supply amount such that a deviation between the determined desired idling speed and the detected engine speed decreases; and valve controlling means for controlling the opening of the valve to a value that effects the desired secondary air supply amount;

wherein the improvement comprises:

clutch position detecting means for detecting whether or not the clutch is at a neutral position, said clutch position detecting means being configured as a neutral switch to output either of two signals, one of said signals indicating that the clutch is in a neutral position and the other of said signals indicating that the clutch is in a forward or a reverse position such that the clutch position detecting means outputs the same signal when the clutch is in a forward position and when the clutch is in a reverse position;

wherein the desired value determining means determines the desired idling speed and the desired secondary air supply amount based on the determined engine start-state and the detected clutch position.

2. A system according to claim 1, wherein the desired value determining means determines to correct the desired secondary air supply amount by a prescribed amount such that the deviation between the desired idling speed and the detected engine speed decreases, when the clutch position is changed.

3. A system according to claim 1, wherein the desired idling speed is at least one of a desired engine speed during idling when the clutch is at the neutral position and a desired engine speed during trolling when the clutch position is at the forward position or the reverse position such that the boat is propelled forward or reverse.

4. A system for controlling an idling speed for an outboard motor mounted on a boat and equipped with an internal combustion engine whose output is connected to a propeller through a clutch such that the boat is propelled forward or reverse when the clutch is changed from a neutral position to a forward position or a reverse position, having:

secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve;

engine operating condition detecting means for detecting parameters indicative of operating conditions of the engine including at least an engine speed;

engine start-state determining means for determining engine start-state as to whether the engine has been started based on one of the detected parameters;

desired value determining means for determining a desired idling speed and for determining a desired secondary air supply amount such that a deviation between the determined desired idling speed and the detected engine speed decreases; and valve controlling means for controlling the opening of the valve to a value that effects the desired secondary air supply amount;

wherein the improvement comprises:

clutch position detecting means for detecting the position of the clutch;

wherein the desired value determining means determines the desired idling speed and the desired secondary air supply amount based on the determined engine start-state and the detected clutch position; and wherein the desired value determining means learning-controls the determined desired secondary air supply amount.

5. A system according to claim 4, wherein the desired value determining means learning-controls the determined desired secondary air supply amount such that the deviation between the desired idling speed and the detected engine speed decreases.

6. A system according to claim 5, wherein the desired value determining means learning-controls the determined desired secondary air supply amount by smoothing a base current command value which is determined such that deviation between the desired idling speed and the detected engine speed decreases.

7. A system according to claim 6, wherein the desired value determines smooths a difference between the base current command value and a coolant correction value.

8. A system according to claim 5, wherein the desired value determining means determines to correct the desired secondary air supply amount by a prescribed amount such that the deviation between the desired idling speed and the detected engine speed decreases, when the clutch position is changed.

9. A system according to claim 8, wherein the desired value determining means determines to correct the desired secondary air supply amount by correcting a current command value which is determined based on a base current command value including a learning control value by the prescribed amount such that the deviation between the desired idling speed and the detected engine speed decreases.

10. A system for controlling an idling speed for an outboard motor mounted on a boat and equipped with an internal combustion engine whose output is connected to a propeller through a clutch such that the boat is propelled forward or reverse when the clutch is changed from a neutral position to a forward position or a reverse position, having:

secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve;

engine operating condition detecting means for detecting parameters indicative of operating conditions of the engine including at least an engine speed;

engine start-state determining means for determining engine start-state as to whether the engine has been started based on one of the detected parameters;

desired value determining means for determining a desired idling speed and for determining a desired secondary air supply amount such that a deviation between the determined desired idling speed and the detected engine speed decreases; and valve controlling means for controlling the opening of the valve to a value that effects the desired secondary air supply amount;

wherein the improvement comprises:

clutch position detecting means for detecting the position of the clutch;

wherein the desired value determining means determines the desired idling speed and the desired secondary air supply amount based on the determined engine start-state and the detected clutch position;

wherein the desired value determining means determines to correct the desired secondary air supply amount by a prescribed amount such that the deviation between the desired idling speed and the detected engine speed decreases, when the clutch position is changed; and wherein the desired value determining means determines to correct the desired secondary air supply amount by correcting a current command value which is determined based on a base current command value including a learning control value by the prescribed amount such that the deviation between the desired idling speed and the detected engines speed decreases.

11. A method of controlling an idling speed for an outboard motor mounted on a boat and equipped with an internal combustion engine whose output is connected to a propeller through a clutch such that the boat is propelled forward or reverse when the clutch is changed from a neutral position to a forward position or a reverse position, and having secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve; including the steps of:

detecting parameters indicative of operating conditions of the engine including at least an engine speed;

determining engine start-state as to whether the engine has been started based on one of the detected parameters;

determining a desired idling speed and a desired secondary air supply amount such that a deviation between the determined desired idling speed and the detected engine speed decreases; and controlling the opening of the valve to a value that effects the desired secondary air supply amount;

wherein the improvement comprises the steps of:

detecting whether or not the clutch is at a neutral position by outputting either of two signals, one of said signals indicating that the clutch is in a neutral position and the other of said signals indicating that the clutch is in a forward or a reverse position, the same signal being output when the clutch is in a forward position and when the clutch is in a reverse position; and determining the desired idling speed and the desired secondary air supply amount based on the determined engine start-state and the detected clutch position.

12. A method according to claim 11, wherein the desired value determining step includes determining to correct the determined secondary air supply amount by a prescribed amount such that the deviation between the desired idling speed and the detected engine speed decreases, when the clutch position is changed.

13. A method according to claim 11, wherein the desired idling speed is at least one of a desired engine speed during idling when the clutch is at the neutral position and a desired engine speed during trolling when the clutch position is at the forward position or the reverse position such that the boat is propelled forward or reverse.

14. A method of controlling an idling speed for an outboard motor mounted on a boat and equipped with an internal combustion engine whose output is connected to a propeller through a clutch such that the boat is propelled forward or reverse when the clutch is changed from a neutral position to a forward position or a reverse position, and having secondary air supplier that supplies secondary air through a passage that is connected to an air intake pipe downstream of a throttle valve and that is equipped with a secondary air control valve such that amount of secondary air is supplied to the air intake pipe in response to an opening of the secondary air control valve; including the steps of:

detecting parameters indicative of operating conditions of the engine including at least an engine speed;

determining engine start-state as to whether the engine has been started based on one of the detected parameters;

determining a desired idling speed and a desired secondary air supply amount such that a deviation between the determined desired idling speed and the detected engine speed decreases; and controlling the opening of the valve to a value that effects the desired secondary air supply amount;

wherein the improvement comprises the steps of:

detecting the position of the clutch; and determining the desired idling speed and the desired secondary air supply amount based on the determined engine start-state and the detected clutch position; and wherein the desired value determining step includes learning-controlling the determined desired secondary air supply amount.

15. A method according to claim 14, wherein the desired value determining step includes learning-controlling the determined desired secondary air supply amount such that the deviation between the desired idling speed and the detected engine speed decreases.

* * * * *